US005553874A

United States Patent [19]

Schouten et al.

[11] Patent Number: 5,553,874

[45] Date of Patent: Sep. 10, 1996

[54] TRUCK ASSEMBLY FOR ROLLER BOARD APPARATUS

[76] Inventors: Pieter Schouten, 1018 7th St., Hermosa Beach, Calif. 90254; Michael Siminian, 9759 El Arco Dr., Whittier, Calif. 90603

[21] Appl. No.: 300,743

[22] Filed: Sep. 6, 1994

[51] Int. Cl.[6] ..... A63C 17/04

[52] U.S. Cl. ..... 280/11.28; 280/87.042

[58] Field of Search ..... 280/11.19, 11.27, 280/11.28, 87.041, 87.042; 180/7.1; 301/5.23, 5.3, 5.1, 1

[56] References Cited

U.S. PATENT DOCUMENTS

| | | | |
|---|---|---|---|
| 3,331,612 | 7/1967 | Tietge | 280/11.28 |
| 3,465,843 | 9/1969 | Guinot | 301/5.23 |
| 4,645,223 | 2/1987 | Grossman | 280/11.28 |
| 5,246,238 | 9/1993 | Brown | 301/5.23 |
| 5,312,120 | 5/1994 | Wiegner | 280/11.28 |
| 5,312,165 | 5/1994 | Spletter | 301/5.23 |
| 5,383,715 | 1/1995 | Homma et al. | 301/5.23 |

*Primary Examiner*—Richard M. Camby
*Attorney, Agent, or Firm*—George R. McGuire

[57] ABSTRACT

A roller board apparatus, such as a skateboard, having an elongated user support platform and front and rear rigid, curve axels mounted transversly across one side of the platform adjacent the front and rear ends, respectively. The axels curve symmetrically outwardly away from the platform surface to which they are attached and respectively include a plurality of wheels rotatably mounted therealong, thereby creating, in essence, an arc of wheels. Resilient, rubber, wedge shaped spacers are positioned between each end of the axels and the platform, for the primary purpose of causing the axels to angle outwardly away from one another so as to provide stability to the board. The spacers resiliency permit the angle at which each angle sits with respect to the horizontal to be selectively chaned. Different angles produce different riding characteristics. Among those different ride characteristics is included characteristics which accurately simulate the ride characteristics experienced when surfing or snowboarding.

11 Claims, 3 Drawing Sheets

10
12
14
16
18
20
22
24
26
38
T
A
B

TRUCK ASSEMBLY FOR ROLLER BOARD APPARATUS

BACKGROUND OF THE INVENTION

1. Field of Invention

The present invention relates generally to recreational roller board equipment, such as skateboards, and more particularly to a truck assembly for a roller board apparatus which creates a riding experience simulative of wave surfing or snow boarding.

2. Description of the Prior Art

Recreational activities such as skateboarding, snow boarding, wave surfing and wind surfing each have the common element of requiring their participants to develop the skill of balancing themselves on a relatively planar platform while propelling themselves forward by having to transfer their weight in a certain manner to effect a turn. Due to this common underlying element of these various activities, they tend to attract common individuals. Hence, an individual who skateboards would probably like to wave surf, snow board and wind surf.

Unfortunately, wave surfing and wind surfing each require the use of water, most suitably an ocean, and snow boarding obviously requires mountains and snow. Therefore, these activities can only be performed during certain seasons and only in certain locations, while skateboarding can be performed in any location during essentially any season. Thus, it would be enticing to those who enjoy the above-described activities to have a skate board type apparatus which could effectively simulate the feel of each of the other activities.

Traditional skateboard apparatus is basically comprised of an elongated planar platform having two straight axles positioned transversely across each end of the platform. Wheels pivotally mounted on the ends of the axles provide a stable motive base similar to that of an automobile. A user of the board stands on the non-wheeled side of the platform and propels himself along by pushing the ground with one foot while balancing himself on the platform with his other foot. Since the wheels are pivotally mounted, turns can be accomplished by transferring one's weight in the desired turn direction. While a turn can be successfully accomplished, the turning motion is not as fluid and uninterrupted as a turn performed in surfing or snow boarding where the inward edge of the platform very nearly, or does, contact the transport medium (i.e., water or snow). Furthermore, when turning on conventional the skateboard the inward edge may lower slightly, but the pivoted wheel is truly where the majority of the turn occurs. Therefore, a quick, jerky shift in weight will accomplish a turn just as well as a slow, fluid, uninterrupted transfer of weight.

U.S. Pat. No. 4,744,576 to Scollan Jr. discloses a roller board which attempts to simulate the feel of snow or water skiing wherein a shift in weight in one direction causes a turn in an opposite direction. The invention utilizes two separate axles on both the front and the rear of the platform. One of the axles carries two wheels which are always in contact with the ground thus providing support to the platform, and the second axle carries wheels at lateral extremities of the board and provide wheels to guide the board through a turn. The wheels are positioned so far laterally away from the side edges of the platform a tight turn around a curb or other obstacle cannot be achieved.

U.S. Pat. No. 4,887,824 to Zatlin discloses a skate board having three sets of two wheels each positioned at both the forward and rearward ends of a platform which is curved upwardly in a transverse direction. Therefore the three sets of wheels extend essentially along a curved axis. Thus, when shifting one's weight to make a turn, the inwardly facing edge must drop below its normal height above ground level in order for the outer set of wheels to contact the ground. However, this drop is compensated for by the curved shape of the platform, thus maintaining a considerable distance between the ground and the board's edge.

OBJECT AND ADVANTAGES

It is therefore a primary object of the present invention to provide a roller board apparatus which accurately simulates the feel of a wave or wind surfing Board, or a snow board.

It is a further object of the present invention to provide a roller board apparatus which is easy and inexpensive to manufacture.

It is another object of the present invention to provide a roller board apparatus which may be easily modified to be more or less responsive in a turn.

Other objects and advantages of the present invention will in part be obvious and in part appear hereinafter.

SUMMARY OF THE INVENTION

In accordance with the foregoing objects and advantages, the present invention provides a roller board apparatus which accurately simulates the feel of a wave surf board, snow board or wind surf board. The roller board is basically comprised of a conventional elongated platform having first and second axles attached at their ends to the side edges of the platform, transversely across the front and rear ends thereof, respectively. Each axle is symmetrically curved outwardly from the platform, thereby creating an axle which is farthest away from the platform at its center and closest to the platform at its edges. Each axle has a plurality of wheels non-pivotally mounted thereon, thereby creating, in essence, an arc of wheels.

After the wheels are mounted on their axles, the axles are attached to the bottom surface of the platform by a truck assembly. The truck assembly includes mounting brackets to which the ends of the axles are attached, and resilient, rubber spacer elements disposed between the mounting brackets and the bottom surface of the platform. The spacer elements each include two substantially planar surfaces which are disposed at an acute angle to one another when the spacer is in an decompressed state. The spacers are attached to the mounting brackets which hold the axles such that the axles will angle outwardly away from one another, thereby giving the board a stable base. But since the spacers are resilient they may be compressed, which thereby diminishes the angle formed between their two planar surfaces and, hence, diminishes the angle at which the two axles are disposed with respect to one another. This compression/decompression of the resilient spacers effectively permit the user to selectively pivot each of the axles about an axis transverse to the longitudinal axis of the platform. Further, it is also possible for the user to compress only the front (or rear) spacers while leaving the rear (or front) spacers uncompressed, thereby pivoting one axe at a different angle than the other.

When the spacers are compressed the board has less responsive ride characteristics than if the spacers were left decompressed. The responsiveness is a measure of how rapid and sharp of a turn is achieved for a predetermined transition in a rider's weight. Thus, when the spacers are compressed, a turn is achieved gradually for a predetermined transfer in weight and when the spacers are decompressed, a turn is rapidly achieved for the same, predetermined transfer in weight.

When only the front or the rear spacers are compressed and the opposing spacers are decompressed, the axle having the compressed spacers will turn more gradually than the axle having the decompressed spacers, thereby "kicking out" this axle from the opposed axle. Therefore, if the front spacers are compressed and the rear spacers are decompressed, when a rider leans the board into a turn the rear of the board will turn more rapidly than the front of the board (i.e., the rear of the board will kick out when turning). This type of turn is substantially identical to the type of turn made when snowboarding. If the front spacers are decompressed and the rear spacers are compressed, when a rider leans the board into a turn the front of the board will turn more rapidly than the rear of the board. This type of turn is substantially identical to the turn experienced when surfing.

BRIEF DESCRIPTION OF THE DRAWINGS

The invention will be further described in connection with the drawing figures, in which.

DETAILED DESCRIPTION

Figures 1A, 1B, 1C, 2, 3:
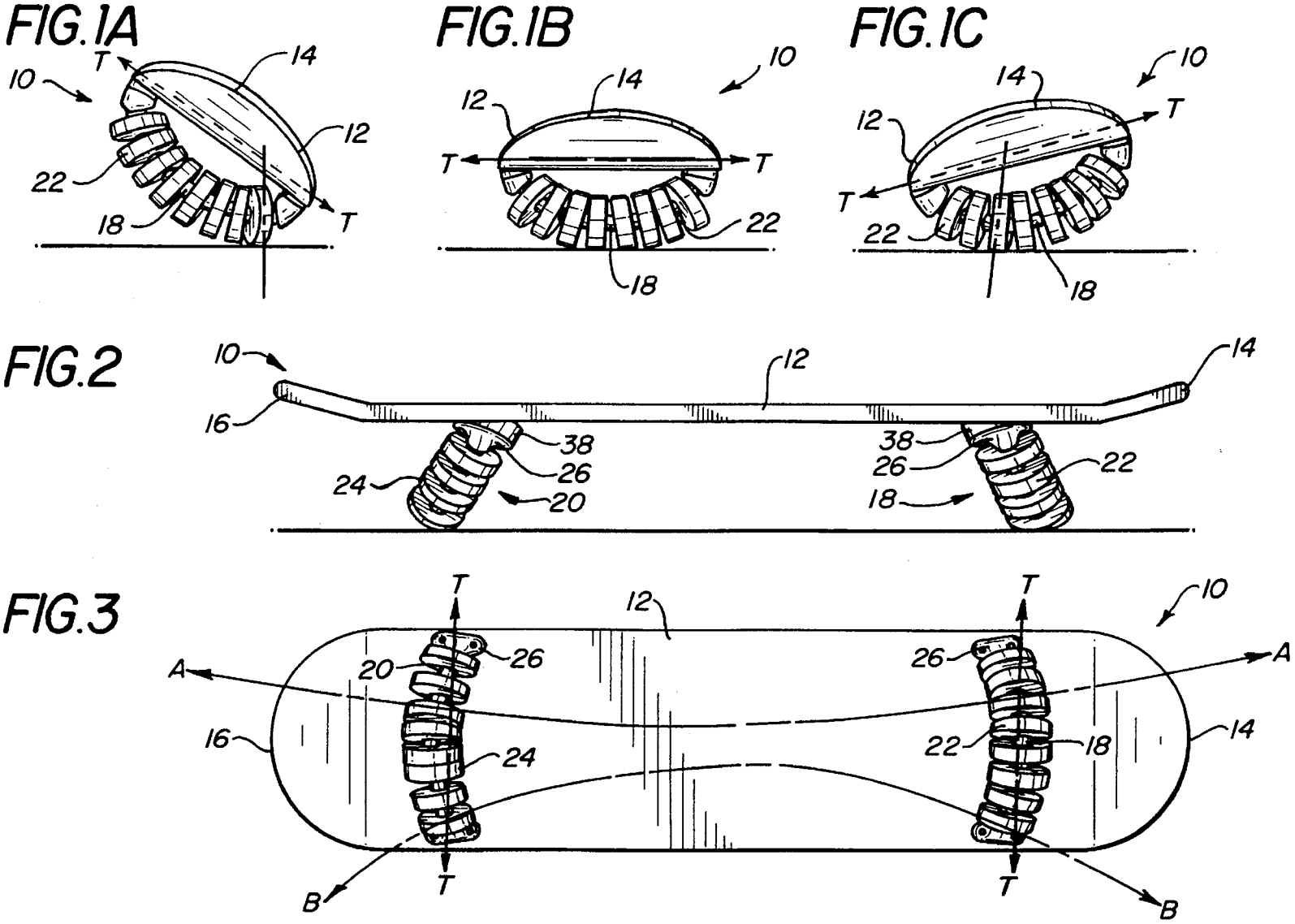
FIG. 1A is a front elevational view of the skateboard of the present invention, showing the board's outermost wheel contacting the ground.
Figure 1B is the front elevational view of FIG. 1A, showing the board's middle wheels contacting the ground.
FIG. 1C is the front elevational view of FIG. 1A, showing one of the board's intermediate wheels contacting the ground.
FIG. 2 is a side elevational view of the present invention.
FIG. 3 is a bottom plan view of the present invention, illustratively showing the turning radius produced by various ground contacting wheels.

Referring now to the drawings, wherein like reference numerals refer to like parts throughout, there is seen in FIGS. 1–6 a skateboard denoted generally by reference numeral 10. Skateboard 10 is seen to include a conventional, planar, elongated skateboard platform 12 having front and rear ends 14 and 16, respectively, which are both angled slightly upwardly from the major planar portion of platform 12 to provide stable foot resting surfaces. Skateboard 10 further includes front and rear axles 18 and 20, respectively, positioned transversely across the front and rear portions of platform 12, respectively. Axles 18 and 20 are each attached at their ends to the bottom surface of platform 12 and they bow, or curve symmetrically outwardly away therefrom. Further, axles 18 and 20 each include a plurality of wheels 22 and 24, respectively, mounted thereon in a manner which will be explained in greater detail hereinafter.

Figure 7:
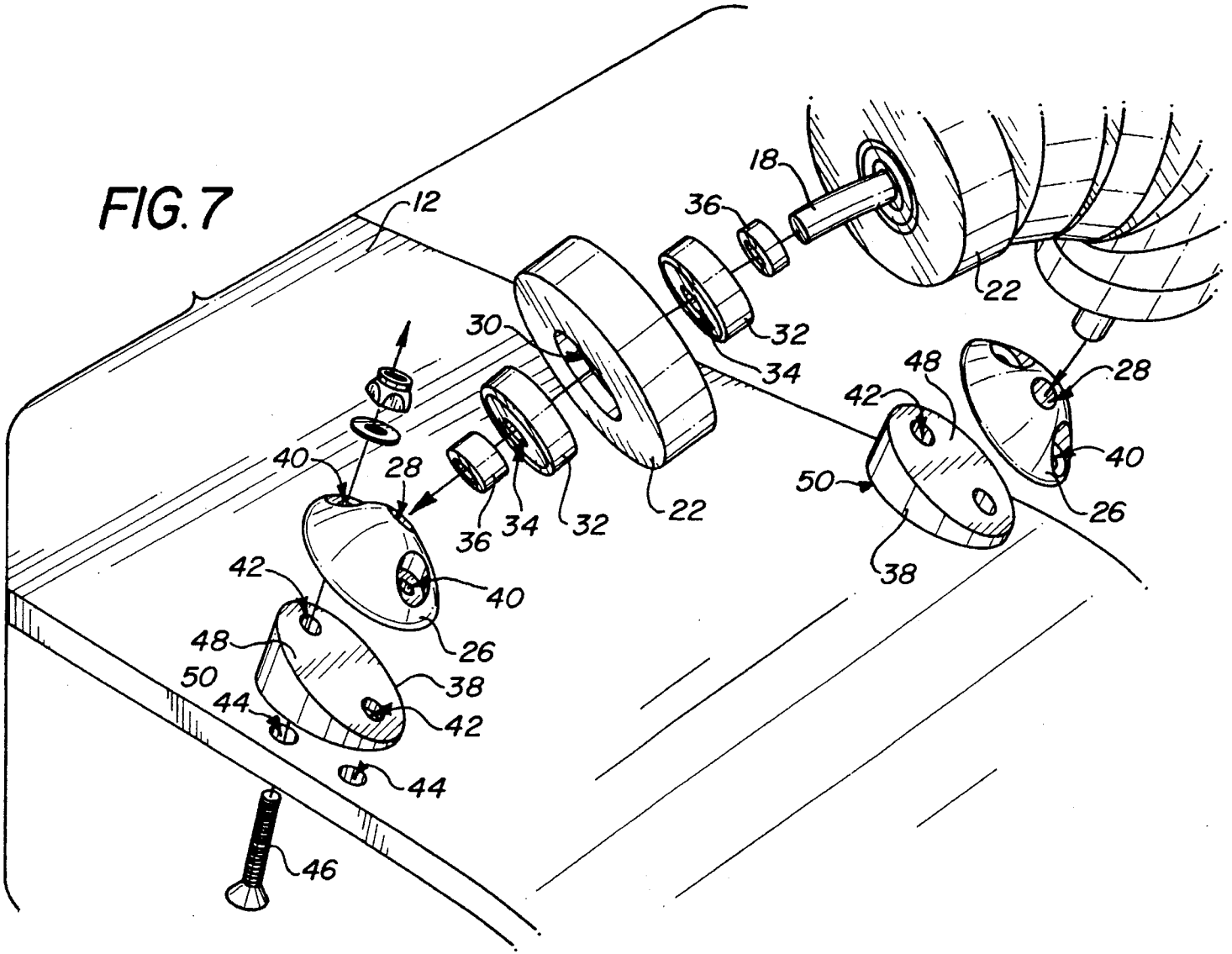
FIG. 7 is an exploded view of a truck assembly of the present invention with the elements thereof shown in position with respect to the board's platform.

Referring to the exploded view of FIG. 7, each axle is attached to the bottom surface of platform 12 by attachment of its ends to a pair of mounting brackets 26. Mounting brackets 26 include an angled, central bore 28 formed therein for reception of the ends of the axle. The angular formation of bore 28 creates a positional relation between the ends of the axle and mounting bracket 26 which prohibits the axle from becoming detached from mounting bracket 26.

Before axles 18 and 20 are attached to mounting brackets 26, wheels 22 and 24 must be co-axially mounted thereon, respectively. The mounting of the plurality of wheels 22 and 24 on axles 18 and 20, respectively, creates essentially an "arc" of wheels on each axle. Each wheel, of course, includes a central opening 30 of predetermined diameter. Disposed within each wheels opening 30, in side by side relation, is a pair of bearings 32 having outside diameters substantially equal to the diameter of opening 30, and a smaller, central opening 34 of a diameter substantially equal to the diameter of axels 18, 20, thereby permitting bearings 32 to securely retain wheels 22, 24 in non-pivotal, rotatable relation with respect to axels 18, 20. Disposed between each wheel 22, 24 is a nylon spacer 36 having a central opening 36 which is of substantially equal diameter to axles 18 and 20, thereby permitting spacers 36 to be forcibly slid onto axels 18, 20 to a position (between wheels 22, 24) where they will remain fixed until manually moved elsewhere (each spacer will actually contact the bearing which is positioned within each wheel). Each spacer 36 permits their respective wheel 22, 24 to be positioned where it is to remain fixed until wear on the wheel becomes so great as to necessitate the replacement thereof, or the movement of spacers 36 dictates the corressponding movement of its respective wheels. Bearings 32, of course, are mounted in rotatable relation to spacers 36, thereby permitting wheels 22, 24 to freely rotate with respect to axles 18, 20, respectively.

Although there are a plurality of wheels mounted on each axle 18 and 20, only the two center-most wheels on each axle contact the ground when traveling in a relatively straight path on roller board 10 as is seen in FIG. 1B. When turning, only one or two wheels on each axle contacts the ground at a given time as is clearly seen in FIGS. 1A and 1C.

To turn when riding board 10, it is necessary for a user to transfer their weight in a fluid, uninterrupted motion in the same direction as the desired turn. For a more gradual turn, less weight is shifted and one of the intermediate wheels positioned between the outermost and central-most wheels contacts the ground, as is seen by the turning radius A illustrated in FIG. 3. For a tighter, sharper turn, more weight needs to be shifted in the same direction as the desired turn, thereby causing one of the outermost wheels to contact the ground, as is illustrated by the turning radius B in FIG. 3. Since the wheels are non-pivotally mounted on their respective axles, platform 12 tilts away from the horizontal an amount directly related to the radius of turn (as is illustrated in FIGS. 1A–1C by the angle formed between transverse axis T-T and the ground. In addition, this fluid transference of weight to dictate the degree of turn as applied to board 10 accurately simulates the procedure and feelings associated with turning a wave or wind surfboard or a snowboard, as in each of these activities the user support platform tilts approximately the same amount away from the horizontal as the radius of turn dictates (i.e., the greater or more severe the turn, the greater the angle formed between the platform's transverse axis and the horizontal).

Figure 4:
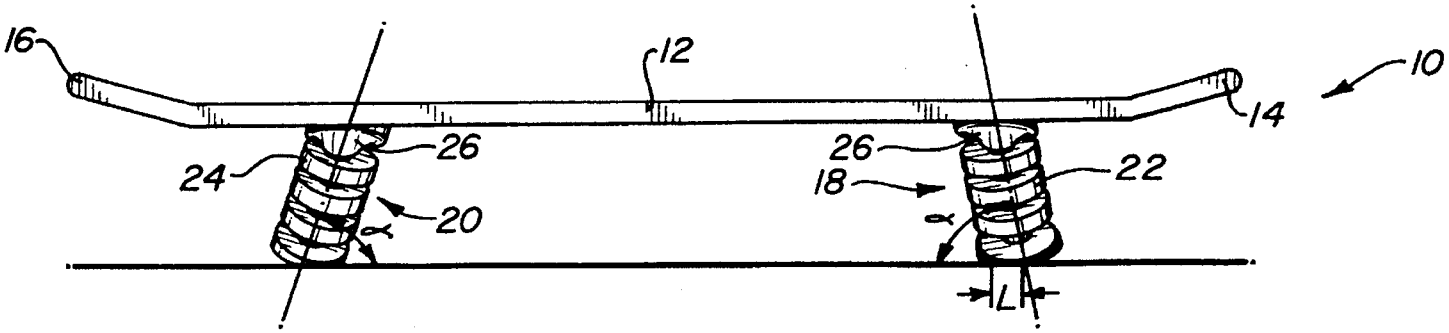
FIG. 4 is a side elevational view of the present invention, showing both truck assemblies attached to the board's platform with spacers completely compressed.

To provide stability to board 10 when making turns, it is imperative that axles 18 and 20 are angled at least slightly away from one another (i.e., that not all the wheels 22 (and 24) are mounted in a common transverse plane. This angled mounting is ensured by the angled bores 28 formed in mounting brackets 26. These bores 28 align axles 18 and 20 at maximum interior angles $\propto$ of about 87 degrees with respect to the ground (or reference horizontal) when mounting brackets 26 are substantially flush with the bottom surface of platform 12, as is seen in FIG. 4 which is most similar to conventional skateboarding, and angles of about 60 degrees when at a minimum. This angular disposition of axles 18 and 20 provides board 10 with a lateral spacing of ground contacting wheels, wherein the maximum spacing between ground contacting wheels occurs when traveling in a straight path and a minimum spacing between ground contacting wheels occurs when making the sharpest of turns. Therefore, when making even the sharpest turn the angular tilting of platform 12 with respect to the horizontal is never perpendicular which a rider could not sustain, but is rather, always of an angle sustainable by a rider of the board (i.e. maximum of about 87 degrees).

The angle at which platform 12 tilts with respect to the horizontal, and thus the angular displacement between axles 18 and 20, is selectively adjustable by the incorporation of resilient, rubber spacer elements 38 in the truck assembly. Spacing elements 38 are disposed between mounting brackets 26 and the bottom surface of platform 12. Mounting brackets 26, spacer elements 38 and platform 12 each include pairs of axially aligned screw holes 40, 42 and 44, respectively, which, of course, threadingly receive screws 46 (only one screw is shown) to securely attach the truck assembly to platform 12.

Figure 5:
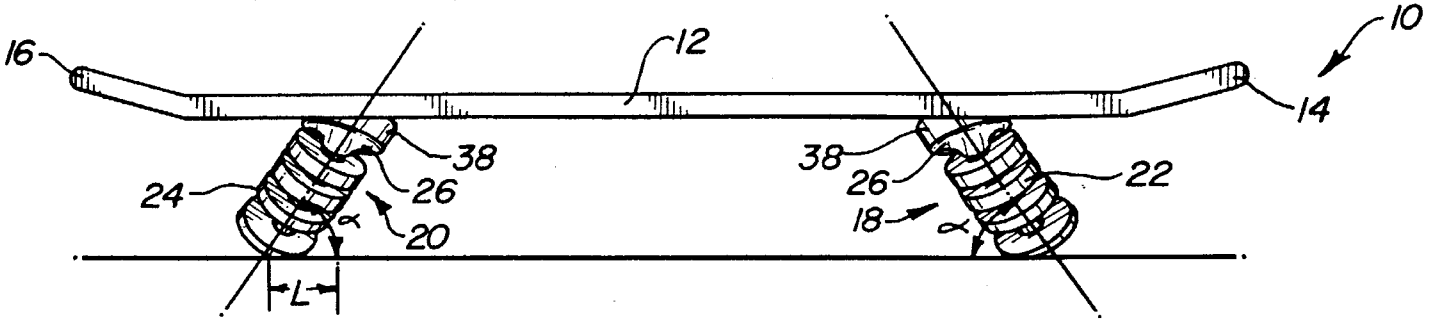
FIG. 5 is the side elevational view of FIG. 4, showing both truck assemblies attached to the board's platform with spacers completely uncompressed.

As previously mentioned, spacer elements 38 permit axles 18 and 20 to be pivotally adjusted about transverse axis T-T thus permitting angle $\alpha$ to be increased or decreased to suit the desires of the user. Spacer elements 38 include first and second substantially planar surfaces 48 and 50 positioned in contacting relation to the bottom surface of platform 12 and mounting brackets 26, respectively, which are in acute angular relation to one another when elements 38 are in an decompressed state, as is seen in FIGS. 2 and 5. For first and second surfaces 48 and 50 to maintain their angular relation to one another, the mounting screw 46 passing through the inwardly disposed screw receiving holes are only tightened to the point of securely attaching the truck assembly to platform 12, which does not compress spacer element 38 at all, thereby maintaining the total angular relationship between first and second surfaces 48 and 50. To diminish the angles between first and second surfaces 48 and 50 either completely, as is seen in FIG. 4, or in part, screws 46 are tightened appropriately. Since spacer elements 38 are composed of rubber and have resilient properties, the tightening of screws 46 compress spacer elements 38 and the loosening of screws 46 permit spacer elements to decompress by an amount dictated by the degree of loosening.

The incorporation of rubber spacer elements 38 also provides the rider of board 10 with some unique riding qualities. Due to the resiliency of spacer elements 38, when they are not completely compressed and a rider leans board 10 into a turn, the spacer elements 38 on the same side of board 10 as the turning direction become slightly compressed. When coming out of the turn, spacer elements 38 return to their original state. The compression-decompression of spacer elements 38 serve to accelerate the board out of turns by ensuring that more surface area of wheels 22 and 24 contact the ground than if non-resilient spacer elements were used.

The use of spacer elements 38 in a fully compressed, or fully decompressed state produces a board which is less responsive, or more responsive, respectively (the responsiveness being a measure of how severe a turn is achieved for a given transfer in weight, or inclination of platform 12). The less responsive board occurs due to the relatively small lateral space L which exists between the center-most and outermost wheels, which requires platform 12 to be tilted a great deal when turning, thus producing a slow, gradual turn. Also, since spacer elements 38 are already fully compressed, they cannot assist the rider in accelerating out of turns. In the more responsive board, there is a relatively large lateral distance separating the center-most from the outer-most wheels on each axle, thereby requiring less tilt of platform 12 when making a turn, thus rapidly producing a sharp turn. Also, the ability of spacer elements 38 to compress and accelerate the board out of a turn in the manner previously described is achievable.

Figure 6:
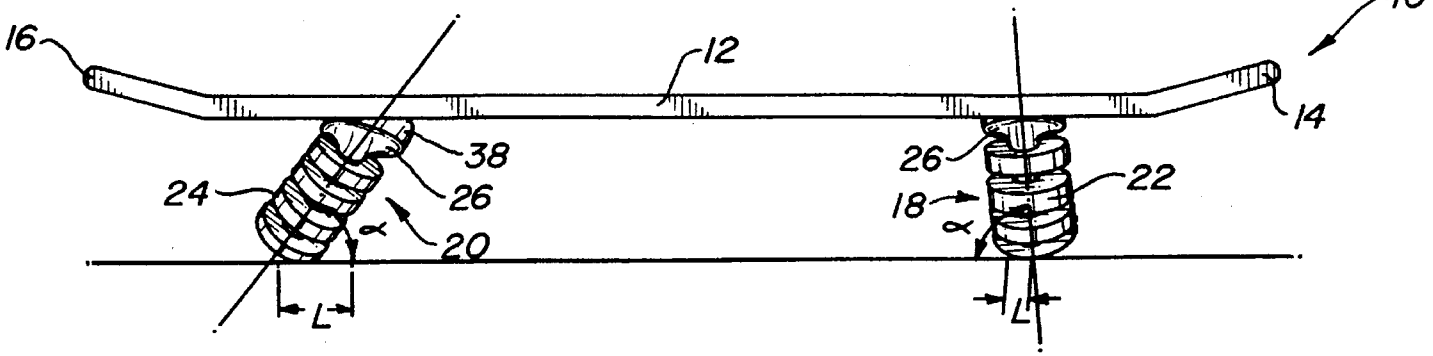
FIG. 6 is the side elevational view of FIG. 4, showing one of the truck assemblies attached to the board's platform with a uncompressed spacer disposed therebetween, and the other truck assembly attached to the board's platform with compressed spacer disposed therebetween.

Referring now to FIG. 6 wherein the spacer elements 38 positioned at the front of board 10 are in a fully compressed state and the spacer elements at the rear of board 10 are fully decompressed, a board having front and rear axles which produce turns of different radii for a given platform inclination is achieved. As shown in FIG. 6, front axle 18 will produce a smaller radius of turn than axle 20 will, thereby causing rear end 16 to turn much more rapidly than front end 14. This type of turn is substantially identical to the type of turn experienced when snow boarding where the rear of the board needs to be kicked out further than the front of the board to carve a turn. If the rear spacer elements 38 were more compressed than the front spacer elements 38, the opposite effect would occur (i.e., the front of the board would turn more than the rear of the board). This type of turn is substantially identical to the turns experienced when surfing where the front of the surf board kicks away from the rear of the board when turning into or out of a wave.

Although it is not shown in the drawing figures, the user support surface of platform may be adapted to receive a conventional sail assembly common to sailboarding. This additional element would provide board 10 with additional simulation features for the sport of sailboarding.

In addition to the preferred embodiment described above, turning radius, ease of weight transition and other ride characteristics may be changed by simply changing the radius of curvature of the axles. Therefore the present invention should not be limited to the preferred embodiment as described above, but instead should extend to the full scope and spirit as defined by the appended claims.

What is claimed is:

1. A roller board apparatus comprising:

a) an elongated user support platform having first and second opposed, major, substantially planar surfaces and a longitudinal axis, said first surface being a user support surface;

b) at least two non-linear wheel carrying axles longitudinally spaced from each other and having respective first and second ends which are attached to said second surface of said platform each set of said first and second ends having a respective axis extending therethrough, said axis extending transverse to said longitudinal axis; and c) means for selectively pivoting at least one of said at least two axles about said transverse axis extending through said and second ends of said at least one of said at least two axles.

2. The invention according to claim 1 wherein said selective pivoting means includes a truck assembly for attaching said axles to said second surface of said platform, said truck assembly having:

a) a plurality of mounting brackets adaptively formed to cooperatively receive said first and second ends of said axles in a blind hole formed therein, thereby securely retaining said axles;

b) a plurality of resilient, wedge shaped spacing elements, wherein one of said spacing elements is disposed between each of said mounting brackets and said second surface of said platform; and c) means for manually compressing and decompressing said spacing elements, wherein said axles pivot about said transverse axis in response to said compressing and decompressing of said spacing elements.

3. The invention according to claim 2 wherein said means for compressing and decompressing said spacing elements includes screws passing through respective sets of axially aligned, screw receiving holes formed through each of said mounting brackets, said spacing elements, and said platform.

4. The invention according to claim 1 wherein each of said at least two axles are rigid and symmetrically curved.

5. The invention according to claim 4 wherein said at least two axles are positioned in outwardly bowing relation with respect to said second surface.

6. The invention according to claim 5 wherein each of said axles includes a plurality of wheels rotatably, radially, non-pivotally mounted thereon.

7. A roller board apparatus comprising:

a) an elongated, user support platform having first and second opposed, major, substantially planar surfaces, and longitudinal and transverse axes, said first surface being a user support surface;

b) at least two rigid, curvi-linear axles having respective first and second ends, respectively, securely attached to said second surface of said platform, said axles extending substantially transversely across said platform;

c) a plurality of wheels rotatably, radially mounted on each of said at least two axles; and d) means for attaching each of said axles to said second surface of said platform.

8. The invention according to claim 7 wherein said mounting means includes:

a) a plurality of mounting brackets each adaptively formed to cooperatively receive one of said terminal ends of said axles in a blind hole formed therein, said mounting brackets further including screw receiving holes formed therethrough;

b) a plurality of resilient, wedge shaped spacing elements, wherein one of said spacing elements is disposed between a respective said mounting bracket and said second surface of said platform, said spacing elements including respective screw receiving holes formed therethrough, wherein each of said spacing element's screw holes are axially aligned with said mounting bracket's screw holes.

9. The invention according to claim 8 and further including means for manually compressing and decompressing said spacing elements, wherein said axles pivot about said platform's transverse axis in response to said compressing and decompressing of said spacing elements.

10. The invention according to claim 7 and further comprising means for selectively positioned each of said wheels along each of said axles.

11. The invention according to claim 10 wherein said wheel positioning means includes at least one wheel spacing members mounted on each of said axles and selectively positioned in abutting relation between each of said wheels.

* * * * *

UNITED STATES PATENT AND TRADEMARK OFFICE

CERTIFICATE OF CORRECTION

PATENT NO. : 5,553,874

DATED : Sep. 10, 1996

INVENTOR(S) : Pieter Schouten and Michael Simonian

It is certified that error appears in the above-indentified patent and that said Letters Patent is hereby corrected as shown below:

On the Title page, item [76] Inventors; please delete "Siminian" and substitute therefore --Simonian--

In the Abstract:
Line 3 Please delete "curve" and substitute therefor --curved--.
Line 13 Please delete the second instance of "angle" and substitute therefor --axle--.
Line 14 Please delete "chaned" and substitute therefor --changed --.

Column 1 line 49 Please delete the first instance of "the"; and delete "skateboard" and substitute therefor --skateboards--.
line 62 Please delete "provide" and substitute therefor --provides--.

Column 2 line 61 Please delete "axe" and substitute therefor --axle--.

Column 5 line 4 Please insert --,-- following "plane".

Signed and Sealed this

Twenty-first Day of January, 1997

*Attest:*

*Attesting Officer*

BRUCE LEHMAN

*Commissioner of Patents and Trademarks*